US008033277B2

(12) United States Patent
Gordon et al.

(10) Patent No.: US 8,033,277 B2
(45) Date of Patent: Oct. 11, 2011

(54) BOWSTRING VIBRATION DAMPENER AND MOUNTING

(75) Inventors: Sean Gordon, Evansville, IN (US); Ben Blosser, Richland, IN (US)

(73) Assignee: Bear Archery, Inc., Evansville, IN (US)

( * ) Notice: Subject to any disclaimer, the term of this patent is extended or adjusted under 35 U.S.C. 154(b) by 446 days.

(21) Appl. No.: 12/208,736

(22) Filed: Sep. 11, 2008

(65) Prior Publication Data

US 2009/0071457 A1 Mar. 19, 2009

Related U.S. Application Data

(60) Provisional application No. 60/972,398, filed on Sep. 14, 2007.

(51) Int. Cl.
*F41B 5/20* (2006.01)

(52) U.S. Cl. ..... 124/88; 124/25.6; 124/86; 124/89; 124/90; 124/92

(58) Field of Classification Search ..... 124/25.6, 124/86, 88, 89, 92, 90
See application file for complete search history.

(56) References Cited

U.S. PATENT DOCUMENTS

| | | | | |
|---|---|---|---|---|
| 2,474,723 | A | 6/1949 | Boose | |
| 2,709,938 | A | 6/1955 | Schmid | |
| 2,765,827 | A | 10/1956 | Hall | |
| 2,777,347 | A | 1/1957 | Sendoykas | |
| 2,906,150 | A | 9/1959 | Stewart | |
| 3,037,219 | A | 6/1962 | Webb | |
| 3,342,172 | A | 9/1967 | Sanders | |
| 3,446,200 | A | 5/1969 | Gross | |
| 3,502,062 | A | 3/1970 | Shurts | |
| 3,545,789 | A | 12/1970 | Graham | |
| 3,808,870 | A | 5/1974 | Blancett | |
| 3,923,036 | A | 12/1975 | Jennings et al. | |
| 3,971,244 | A | 7/1976 | Zengerer | |
| 4,061,125 | A * | 12/1977 | Trotter | 124/23.1 |
| 4,071,014 | A | 1/1978 | Trotter | |
| 4,200,130 | A | 4/1980 | Reamy | |
| D257,619 | S | 12/1980 | Eastman, II et al. | |
| 4,252,318 | A | 2/1981 | Thibodeau | |
| 4,452,222 | A | 6/1984 | Quartino | |

(Continued)

OTHER PUBLICATIONS

Double STS Archery System [online] http://www.stswarcher.com/double.htm [retrieved on Dec. 12, 2006].

(Continued)

*Primary Examiner* — Alexander Niconovich
(74) *Attorney, Agent, or Firm* — Woodard, Emhardt, Moriarty, McNett & Henry LLP

(57) ABSTRACT

An archery bow comprises an archery bow body defining opposing limb tips, a bowstring extending between the limb tips along a bowstring axis, and an elongate member extending from the bow body, the elongate member having a length and a proximal end arranged adjacent the bowstring. The archery bow further comprises a dampening element made of a vibration dampening material mounted to the proximal end of the elongate member between the proximal end and the bowstring. The elongate member extends from the bow body along a first axis non-perpendicular to the bowstring axis. Additionally, the elongate member may be curved along at least a portion of its length. In certain embodiments, the archery bow body defines a nested mounting area configured as an open channel to receive a distal end of the elongate member.

13 Claims, 4 Drawing Sheets

U.S. PATENT DOCUMENTS

| | | | | | |
|---|---|---|---|---|---|
| 4,461,267 | A | * | 7/1984 | Simonds et al. | 124/25.6 |
| 4,628,892 | A | * | 12/1986 | Windedahl et al. | 124/25.6 |
| 4,817,579 | A | | 4/1989 | Mathias | |
| 4,834,061 | A | * | 5/1989 | Chattin | 124/86 |
| 4,905,988 | A | | 3/1990 | Mooneyhan | |
| 5,119,699 | A | | 6/1992 | McBride et al. | |
| 5,146,908 | A | * | 9/1992 | Larson | 124/88 |
| 5,178,122 | A | * | 1/1993 | Simonds | 124/25.6 |
| 5,323,756 | A | | 6/1994 | Rabska | |
| 5,372,119 | A | * | 12/1994 | Kidney | 124/44.5 |
| 5,373,831 | A | | 12/1994 | Cushman | |
| 5,415,149 | A | * | 5/1995 | Derus et al. | 124/23.1 |
| 5,425,351 | A | | 6/1995 | Kozitka | |
| 5,452,704 | A | * | 9/1995 | Winebarger | 124/92 |
| 5,590,868 | A | | 1/1997 | Hebert et al. | |
| 5,630,407 | A | * | 5/1997 | Gasser | 124/89 |
| 5,682,871 | A | * | 11/1997 | Walk et al. | 124/88 |
| 5,720,269 | A | * | 2/1998 | Saunders | 124/86 |
| 5,762,060 | A | | 6/1998 | Larson | |
| 6,176,156 | B1 | | 1/2001 | Coonrad | |
| 6,237,584 | B1 | | 5/2001 | Sims | |
| 6,363,817 | B1 | | 4/2002 | Lamond et al. | |
| 6,425,385 | B1 | * | 7/2002 | Gallops, Jr. | 124/25.6 |
| 6,430,775 | B1 | | 8/2002 | Bushey | |
| 6,499,478 | B1 | | 12/2002 | Perez | |
| 6,532,945 | B1 | * | 3/2003 | Chattin | 124/25.6 |
| 6,550,467 | B2 | * | 4/2003 | Gallops, Jr. | 124/25.6 |
| 6,634,348 | B2 | * | 10/2003 | Gallops, Jr. | 124/25.6 |
| 6,708,684 | B2 | * | 3/2004 | Chattin | 124/25.6 |
| 6,715,479 | B1 | * | 4/2004 | Bunk | 124/25.6 |
| 6,904,900 | B2 | * | 6/2005 | Gallops, Jr. | 124/25.6 |
| 6,925,721 | B2 | * | 8/2005 | Dietz | 33/265 |
| 6,966,314 | B2 | * | 11/2005 | McPherson | 124/89 |
| 6,976,484 | B1 | * | 12/2005 | Gallops, Jr. | 124/25.6 |
| 7,174,809 | B1 | | 2/2007 | Schipul | |
| 7,213,590 | B2 | * | 5/2007 | Pellerite | 124/89 |
| 7,311,098 | B2 | * | 12/2007 | Gallops, Jr. | 124/25.6 |
| 7,721,724 | B2 | * | 5/2010 | Goade | 124/89 |
| 7,753,044 | B2 | * | 7/2010 | Goade | 124/89 |
| 7,793,646 | B2 | * | 9/2010 | Cooper et al. | 124/89 |
| 2002/0104526 | A1 | * | 8/2002 | Chipman | 124/89 |
| 2003/0056779 | A1 | * | 3/2003 | Gallops, Jr. | 124/89 |
| 2003/0056780 | A1 | * | 3/2003 | Gallops, Jr. | 124/92 |
| 2003/0136392 | A1 | * | 7/2003 | McPherson | 124/25.6 |
| 2003/0178017 | A1 | * | 9/2003 | Chattin | 124/25.6 |
| 2004/0134473 | A1 | * | 7/2004 | Gallops, Jr. | 124/25.6 |
| 2005/0268892 | A1 | * | 12/2005 | Gallops | 124/25.6 |
| 2006/0180135 | A1 | * | 8/2006 | Andrews | 124/89 |
| 2006/0278207 | A1 | * | 12/2006 | Goade | 124/89 |
| 2006/0283435 | A1 | * | 12/2006 | Pellerite | 124/89 |
| 2008/0163729 | A1 | | 7/2008 | Stevens | |
| 2008/0236559 | A1 | * | 10/2008 | Barnard | 124/89 |
| 2008/0264400 | A1 | * | 10/2008 | Wright | 124/89 |
| 2009/0000606 | A1 | * | 1/2009 | Cooper et al. | 124/25.6 |
| 2009/0071458 | A1 | * | 3/2009 | Gordon et al. | 124/25.6 |
| 2009/0133683 | A1 | * | 5/2009 | Wright | 124/89 |
| 2010/0089375 | A1 | | 4/2010 | McPherson et al. | |
| 2010/0095943 | A1 | * | 4/2010 | Cooper | 124/89 |
| 2010/0192931 | A1 | * | 8/2010 | Brewster | 124/89 |
| 2010/0224178 | A1 | | 9/2010 | McPherson | |

OTHER PUBLICATIONS

EDS System [online] http://www.stsarchey.com/eds.htm [retreived on Dec. 12, 2006].

Stealthshot String Suppression System advertisements from HOYT 2007 Catalog [pp. 2&3 of the Catalog].

Three pictures of Delta V Archery Bows sold by Bear Archery in the 1980's.

* cited by examiner

BOWSTRING VIBRATION DAMPENER AND MOUNTING

CROSS-REFERENCE TO RELATED APPLICATIONS

This application claims the benefit of U.S. Provisional Application Ser. No. 60/972,398, filed Sep. 14, 2007, which is hereby incorporated by reference in its entirety.

FIELD OF THE INVENTION

The present invention relates generally to archery bows and more particularly pertains to a bowstring vibration dampener for use with and mounted to archery bows.

BACKGROUND OF THE INVENTION

An archery bow stores energy when an archer draws the bowstring. When the bowstring is released, the stored energy propels the arrow. In conventional bows, the bowstring continues to vibrate or oscillate after release until it settles to a stable state. This vibration can be transmitted to the archer making the bow difficult to handle and aim accurately and/or can cause undesired sound which could alert target game.

In certain arrangements, vibration dampeners such as straight rods and dampening elements are mounted to a bow to reduce vibrations; however, an improved vibration dampener and mounting method is desired.

Objects and attendant advantages of this invention will be readily appreciated as the same become more clearly understood by references to the following detailed description when considered in connection with the accompanying drawings in which like reference numerals designate like parts throughout the figures thereof.

SUMMARY OF THE INVENTION

In certain embodiments, an archery bow comprises an archery bow body defining opposing limb tips, a bowstring extending between the limb tips along a bowstring axis, and an elongate member extending from the bow body, the elongate member having a length and a proximal end arranged adjacent the bowstring. The archery bow further comprises a dampening element made of a vibration dampening material mounted to the proximal end of the elongate member between the proximal end and the bowstring. The elongate member extends from the bow body along a first axis defined along the elongate member where the member meets the bow body, the first axis being non-perpendicular to the bowstring axis. Additionally, the elongate member may be curved along at least a portion of its length.

In certain other embodiments, a dampener for an archery bow comprises a tubular rod having a length and defining a distal end and a proximal end. The distal end of the tubular rod is attachable to the body of an archery bow having a bowstring. Additionally, the proximal end of the tubular rod is arrangable adjacent the bowstring. The dampener includes a dampening element made of a vibration dampening material mounted to the proximal end to be arranged between the proximal end and the bowstring. Further, the tubular rod is radially curved along at least half of its length.

In further embodiments, an archery bow comprises an archery bow body defining opposing limb tips and having a front, an opposite back, and two opposing sides. The bow body defines a nested area at a mounting location on one of the sides of the bow body. The archery bow further comprises a bowstring extending between the limb tips along a bowstring axis and a vibration dampener having a distal end and a proximal end, the distal end being mounted to the bow body in the nested area at the mounting location and the proximal end being arranged adjacent the bowstring. In some embodiments, the nested area is an open channel configured to receive the distal end of the dampener. The open channel may include an end portion, a first lateral side portion, an open front opposite the end portion, and an open second lateral side opposite the first lateral side portion, the first lateral side portion being a contact surface of the open channel along the one of the sides of the bow body. Additionally, the archery bow comprises a dampening element made of a vibration dampening material mounted to the proximal end of the dampener between the proximal end and the bowstring.

DESCRIPTION OF PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

Figure 1:
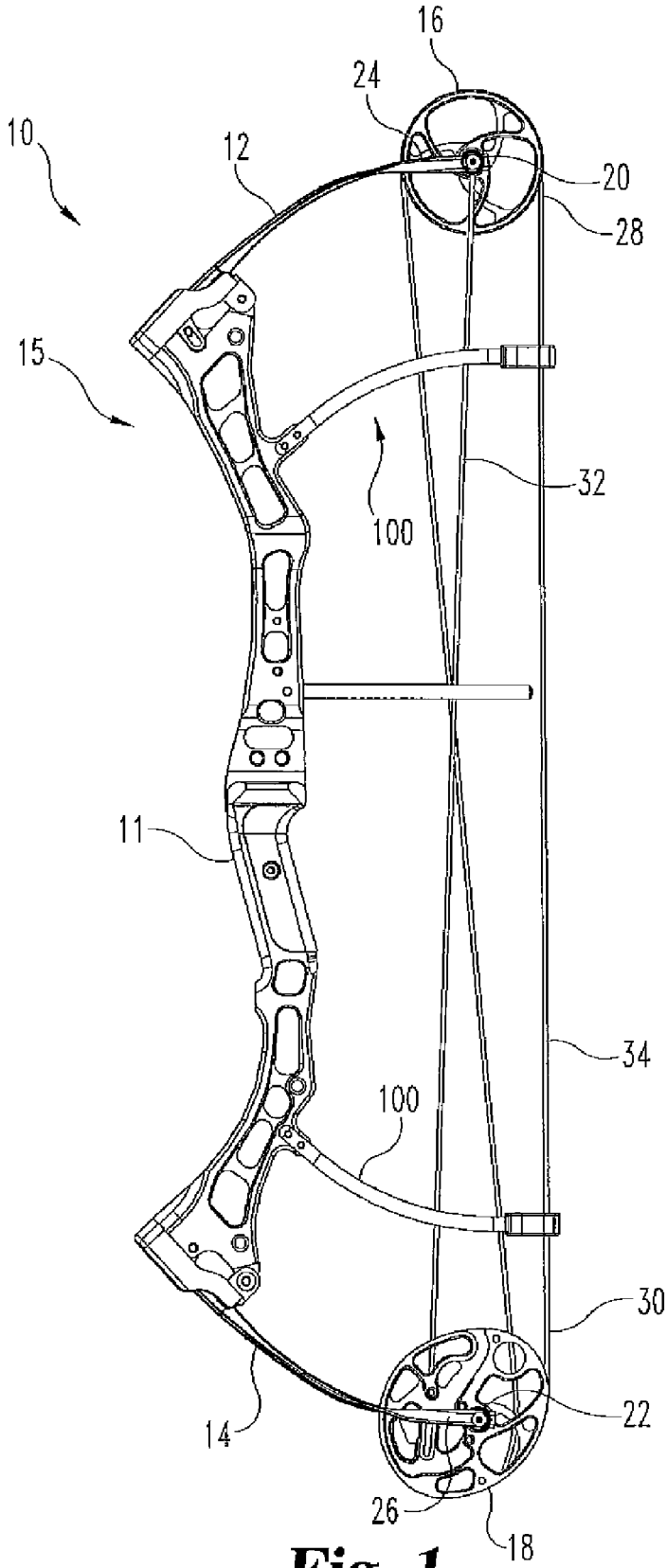
FIG. 1 is a perspective view of an archery bow according to a preferred embodiment of the present invention.

FIG. 1 illustrates one example of a conventional single cam compound archery bow generally designated as 10. When viewed from the perspective of an archer holding the bow 10, the bow body includes a riser 11 with a handle, an upper limb portion 12 and a lower limb portion 14. Rotational members forming one or two variable leverage units such as idler wheel 16 and eccentric cam 18 are supported at the limb tip sections for rotary movement about axles 20 and 22. In the embodiment shown, upper and lower limbs are formed of parallel and symmetric limb portions sometimes called a quad limb. Idler wheel 16 is carried between the outer limb tip portions 24 of upper limb 12. The lower pulley axle 22 is carried between the outer limb tip portions 26 of lower limb 14.

Bowstring 34 includes upper end 28 and lower end 30 which are fed-out from idler wheel 16 and cam 18 when the bow is drawn. Bowstring 34 is mounted around idler wheel 16 and cam 18 as is known in the art. Additionally, a y-yoke anchor cable 32 extends from cam 18 up to axle 20 of wheel 16. From the perspective of the archer, the bowstring is considered rearward relative to the riser which defines forward.

When the bowstring 34 is drawn, it causes idler wheel 16 and cam 18 at each end of the bow to rotate, feeding out cable and bending limb portions 12 and 14 inward, causing energy to be stored therein. When the bowstring 34 is released with an arrow engaged to the bowstring, the limb portions 12 and 14 return to their rest position, causing idler wheel 16 and cam 18 to rotate in the opposite direction, to take up the bowstring 34 and launch the arrow with an amount of energy proportional to the energy initially stored in the bow limbs.

Bow 10 is described for illustration and context and is not intended to be limiting. In addition to single-cam bows, the present invention can also be used with dual-cam compound bows. It can also be used with hybrid cam bows, recurve bows and/or quad limb bows. The present invention can also be used in other types of bows, which are considered conventional for purposes of the present invention. For discussion purposes, the combination of riser 11, limb 12 having limb tip portions 24 and limb 14 having limb tip portions 26 will generally be referred to as archery bow body 15. Accordingly, it should be appreciated that the archery bow body can take on various designs in accordance with the many different types of bows with which the present invention can be used.

FIGS. 1-4 illustrate a vibration dampener mounted to an archery bow according to associated details of certain preferred embodiments. FIG. 1 illustrates two example vibration dampeners 100 mounted to upper and lower portions of riser 11 of bow body 15. Upper and lower vibration dampeners 100 are preferably mirror images, so an upper vibration dampener will be discussed in detail; however, the description is applicable to the lower vibration dampener as well. Alternately, only one or more than one vibration dampener can be mounted to riser at the top, bottom and/or middle of the riser.

Figure 2:
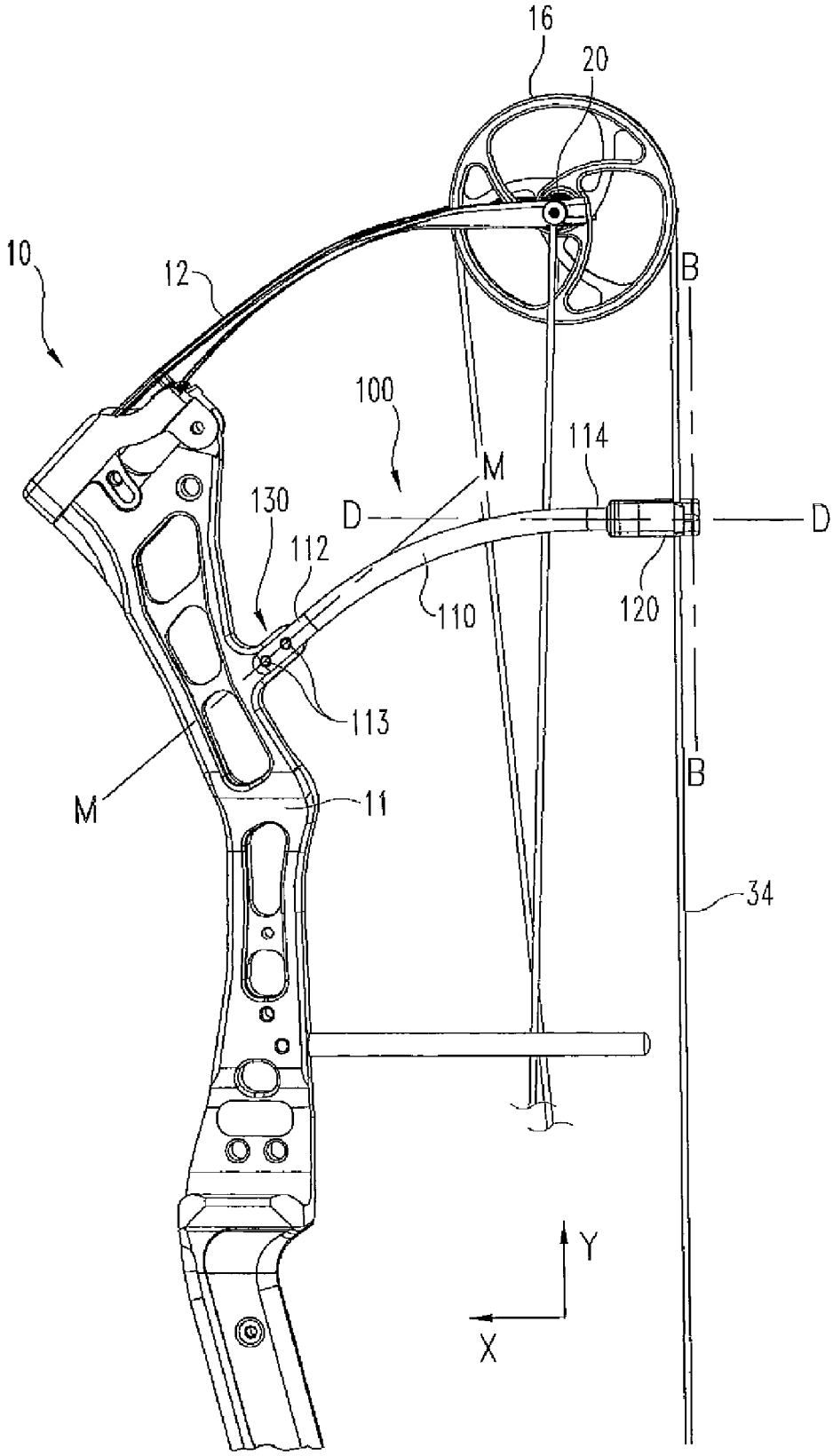
FIG. 2 is an enlarged view of the upper portion of the archery bow of FIG. 1.
Figure 3:
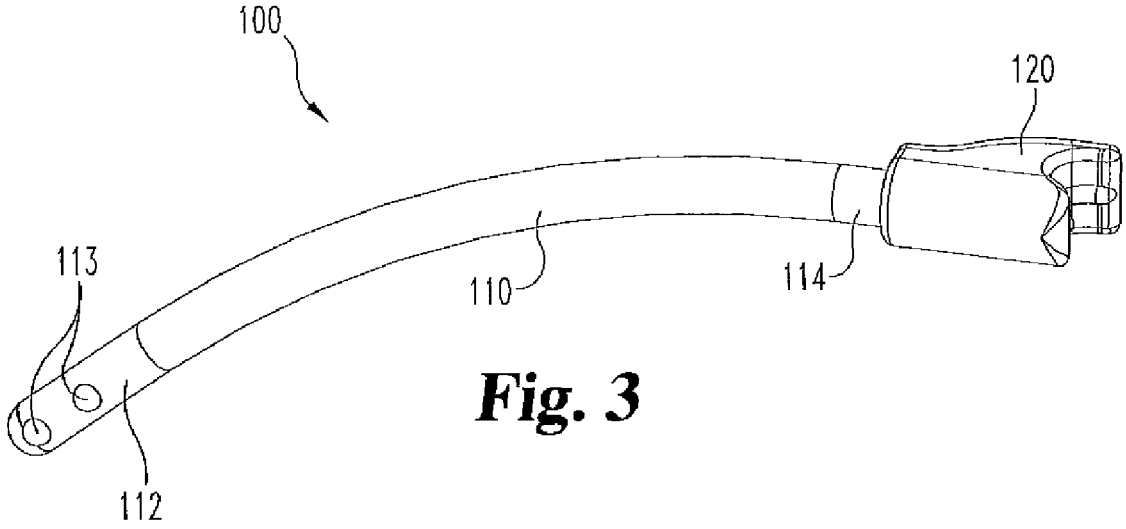
FIG. 3 is a perspective view of a vibration dampener according to one preferred embodiment of the present invention.

In closer detail, FIG. 2 illustrates the upper vibration dampener 100 mounted to riser 11 at a mounting location 130. An illustration of vibration dampener 100 is shown in FIG. 3 as well. Vibration dampener 100, as illustrated, includes an elongate bar or tube 110 having a distal end 112 attachable to riser 11 and a proximal end 114. A vibration dampening element 120 is mounted to the proximal end 114 of dampener 100 and extends between proximal end 114 and bowstring 34 in a rest position.

Dampener 100 may be attached to riser 11 of archery bow body 15 at mounting location 130 in a variety of appropriate methods as would occur to one of ordinary skill in the art. In certain embodiments, dampener 100 may be fastened to riser 11 at mounting location 130 using appropriate fasteners. Accordingly, elongate bar 110 may define one or more bores 113 through which fasteners can be inserted such that the fasteners extend into or through riser 11. In such embodiments, bores 113 may extend through bar 110 in a direction perpendicular to mounting axis M, as illustrated in FIG. 2. Further, the bores 113 may extend in a direction perpendicular to the archery bow plane, the archery bow plane extending vertically from the archery bow body to the bowstring, when the bar 110 is mounted to the archery bow body 15. As an example, cap head screws may be used to mount the bar 110 to the archery bow body 15. In other embodiments, bolts, rivets, welding or adhesive may be used to mount the bar 110 to the bow body 15, although preferably the vibration dampener is selectively removable from the riser when desired. In alternative embodiments, distal end 112 may be molded into riser 11. As a further alternative, bar 110 may be integral with riser 11 as a one-piece construction extending from the riser, where a portion of the bar is cast, forged, molded or machined to extend from a riser section.

In certain embodiments, bar 110 may be curved or bent bar along all or a portion of its length. In a particular embodiment, bar 110 is curved along at least half of its length. As illustrated, bar 10 may have a generally curved, cylindrical shape with a circular cross-section. In the example illustrated, distal end 112 of bar 110 is mounted to the riser 11 along mounting axis M which is angled or non-perpendicular with respect to the bowstring 34 and its axis B. From distal end 112, the elongate bar 110 curves to position the dampening element 120 attached at proximal end 114 along a dampening axis D perpendicular to the bowstring 34 and its axis B where the dampening element engages the bowstring. Mounting axis M is preferably angled with respect to the Y-axis vertical orientation of riser 11 as well. Functionally, the angled mounting of bar 110 with respect to bowstring 34 results in the displacement of vector forces from the mounting location. More specifically, the vector forces applied to the dampening element 120 along the X-axis by the bowstring after release will not be aligned with mounting axis M and will be offset vertically along the Y-axis from the mounting location 130.

Figure 4:
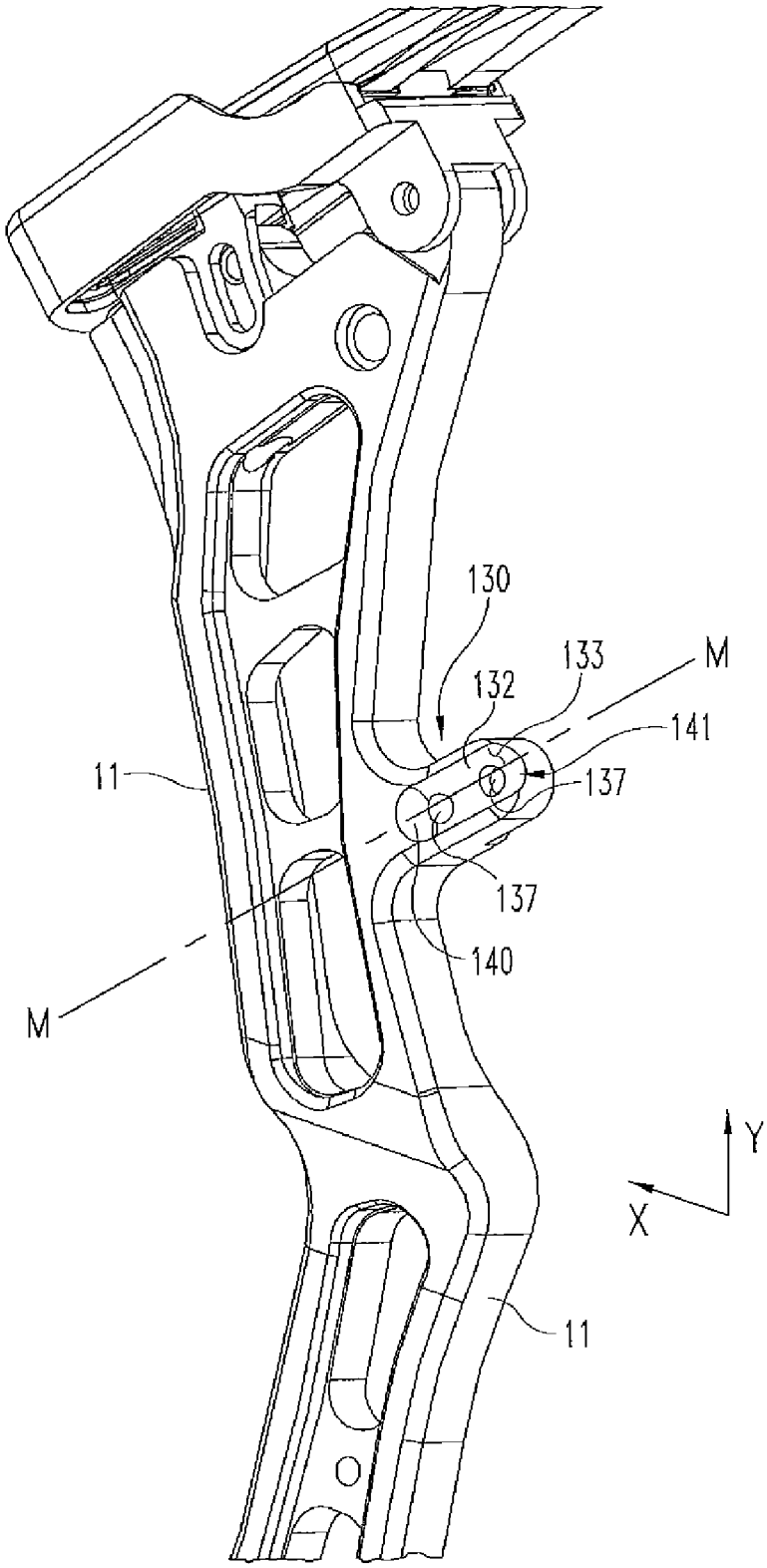
FIG. 4 is a perspective view of a riser and mounting location for a vibration dampener according to a preferred embodiment of the present invention.

FIG. 4 illustrates mounting location 130 in further detail. Additionally, as illustrated mounting location 130 may be positioned on the side of the archery bow body 15. In certain embodiments, riser 11 of archery bow body 15 defines a nested area 132 at location 130 configured to receive distal end 112 of elongate bar 110 of dampener 100. The nested area 132 may be defined along a side surface of the archery bow body. The nested area receives a portion of the bar and engages it to prevent forward, rearward, downward or upward movement of the bar in the X or Y axis relative to the riser. Preferably, the nested area 132 has a cross-section which conforms to the cross-sectional geometry of the bar. Example geometries include part round, square or rectangular, and triangular.

As illustrated, nested area 132 may take the form of an open channel having an arcuate side contact surface 133 for contacting the bar to nest therewith. In such embodiments, the open channel configuration includes an open lateral side to receive the bar opposite surface 133 defined in the archery bow body. Additionally, the open channel configuration includes a back or end surface 140 and an opposite front open area 141. The illustrated nested area 132 extends along a nest mounting axis which is non-perpendicular, angled or skewed relative to the bowstring axis B and associated X and Y axes of the bow and aligned with the mounting axis M of the bar 110. In alternative embodiments, nested area 132 may be substantially parallel with the X-axis.

In the illustrated embodiment, nested area 132 has an arcuate profile matching the outer radius of bar 110. In such embodiments, arcuate contact surface 133 is configured to contact and receive a portion of the bar such that the portion of the bar is nests within the area 132. In certain embodiments, the contacting portion of the bar may fit substantially flush against surface 133. Additionally, the arcuate profile may form an approximately 180 degree engagement with the circumference of the bar, as illustrated, although reduced arcuate ranges can optionally be used. When fasteners are used to connect bar 110 to nested area 132, for example with screws or bolts through bores 113 in the bar and corresponding bores 137 at the mounting location, the bar forms a snug fit with the nested area. In this arrangement, the arcuate surface 133 of nested area 132 engages distal end 112 of bar 110 along an arcuate portion providing a greater grip and resistance to movement when forces are applied to the vibration dampener 100 by the bowstring 34. Preferably, this nested engagement provides a more secure grasp to prevent rotation of dampener 100 either vertically or horizontally relative to the bow 10 and preferably simplifies the mounting or fastening mechanism which is used to mount the dampener to the bow. Nested area 132 can be cast, molded, forged or machined into the riser during or after production of the riser.

Dampener bar 110 can be made of various suitable materials, including steel, aluminum or a fiber reinforced composite shaft, as examples. The bar is preferably round and may optionally be solid or hollow. In certain embodiments, the rod may be extruded into a desired shape, cast, or bent to a shape as desired. Dampening member 120 is preferably formed of a resilient vibration dampening material such as a rubber, urethane or a foam material and may include an open end with a "U", "C" or a "V" style open end facing and engaging the bowstring.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An archery bow, comprising:

an archery bow body including a riser portion and a pair of bow limb members attached to and extending from said riser portion, said bow limb members defining opposing limb tips;

a bowstring extending between said limb tips along a bowstring axis;

an elongate member extending from said riser portion, wherein said elongate member has a length and a proximal end arranged adjacent said bowstring;

a dampening element made of a vibration dampening material mounted to said proximal end between said proximal end and said bowstring;

wherein said elongate member extends from said riser portion along a first axis defined along said elongate member where said member meets said riser portion, said first axis being non-perpendicular to said bowstring axis, wherein said elongate member is curved along at least a portion of its length;

wherein said elongate member includes a distal end mounted to said riser portion and said first axis is a mounting axis arranged through said distal end; and wherein said riser portion defines a nested area and said distal end is mounted in said nested area, wherein said nested area is an open channel extending along a nest mounting axis aligned with said mounting axis of said elongate member, wherein said open channel includes an open lateral side to receive said distal end of said elongate member in said nested area.

2. The archery bow of claim 1, wherein said elongate member defines a dampening axis arranged through said proximal end, wherein said dampening axis is perpendicular to said bowstring axis.

3. The archery bow of claim 1, wherein said nested area has a cross-section which conforms to the cross section of said distal end received in said nested area.

4. The archery bow of claim 3, wherein said elongate member has a circular cross section and includes an outer surface with a radius, wherein said nested area includes an arcuate contact surface with a radius, wherein the radii of said outer surface and said arcuate contact surface match such that said distal end is received in said nested area in a substantially flush arrangement.

5. The archery bow of claim 4, wherein said nested area forms an approximately 180 degree engagement with the circumference of said outer surface of said distal end.

6. The archery bow of claim 1, wherein said nested area has one of a part-round, part-square, part-rectangular or part-triangular cross-section.

7. The archery bow of claim 1, wherein said riser portion includes a front surface facing away from said bowstring, an opposite back surface, and two opposing side lateral surfaces, wherein said nested area is defined in one of said side lateral surfaces.

8. An archery bow, comprising:

an archery bow body including a riser portion and a pair of bow limb members attached to and extending from said riser portion, said bow limb members defining opposing limb tips and said riser portion having a front, an opposite back, and two opposing sides, wherein said riser portion defines a nested area at a mounting location on one of said sides of said riser portion;

a bowstring extending between said limb tips along a bowstring axis;

a vibration dampener having a distal end and a proximal end, wherein said distal end is mounted to said riser portion in said nested area at the mounting location and said proximal end is arranged adjacent said bowstring;

wherein said nested area is an open channel configured to receive said distal end of said dampener, said open channel having a back end surface and an arcuate lateral side surface, at least said arcuate lateral side surface being contact surface of said open channel along said one of said sides of said riser portion;

a dampening element made of a vibration dampening material mounted to said proximal end between said proximal end and said bowstring; and wherein said vibration dampener defines a mounting axis arranged through said distal end which extends from said riser portion, said mounting axis being non-perpendicular to said bowstring axis.

9. The archery bow of claim 8, wherein said nested area has a cross-section which conforms to the cross section of said distal end of said dampener.

10. The archery bow of claim 9, wherein said nested area includes an arcuate profile and said distal end includes a circular cross-section with an outer radius sized to be received in said arcuate profile of said nested area in a flush arrangement.

11. The archery bow of claim 10, wherein said nested area forms an approximately 180 degree engagement with the circumference of said distal end.

12. The archery bow of claim 8, wherein said vibration dampener curves to define a dampening axis arranged through said proximal end, said dampening axis being perpendicular to said bowstring axis.

13. The archery bow of claim 8, wherein said nesting area defines a nest mounting axis aligned with said mounting axis of said dampener.

* * * * *